United States Patent [19]

Chu

[11] Patent Number: 4,836,489

[45] Date of Patent: Jun. 6, 1989

[54] PAPER HOLDER

[75] Inventor: Cornel Chu, London, England

[73] Assignee: Hi Tech Industries, Ltd., London, England

[21] Appl. No.: 30,154

[22] Filed: Mar. 25, 1987

[30] Foreign Application Priority Data

Feb. 11, 1987 [GB] United Kingdom ..... 8703138

[51] Int. Cl.[4] ..... B41J 11/02

[52] U.S. Cl. ..... 248/442.2; 248/451

[58] Field of Search ..... 248/442.2, 447.2, 451; 211/45, 46, 47, 48; 312/7.2, 233; 24/457; 40/341, 352

[56] References Cited

U.S. PATENT DOCUMENTS

| | | | |
|---|---|---|---|
| 1,615,959 | 2/1927 | Slavik | 248/442.2 |
| 2,112,028 | 3/1938 | Kirby | 211/45 |
| 4,279,396 | 7/1981 | Bendock | 248/316.7 X |
| 4,332,364 | 6/1982 | Beskin | 248/442.2 |
| 4,475,705 | 10/1984 | Henneberg | 248/442.2 X |
| 4,582,285 | 4/1986 | Bello | 248/442.2 |
| 4,619,429 | 10/1986 | Mazza | 248/442.2 X |
| 4,632,471 | 12/1986 | Visnapuu | 312/7.2 X |

FOREIGN PATENT DOCUMENTS

| | | | |
|---|---|---|---|
| 2433528 | 1/1976 | Fed. Rep. of Germany | 248/442.2 |

*Primary Examiner*—J. Franklin Foss

*Attorney, Agent, or Firm*—Parmelee, Miller, Welsh & Kratz

[57] ABSTRACT

A paper holder, for holding paper for the operator of a key board, for example, consists of an elongate member defining a slot, the slot being non-linear and at least one dimension. A piece of paper may be inserted into the slotted member, the piece of paper being held in a stiff erect position.

13 Claims, 3 Drawing Sheets

Fig. 4.
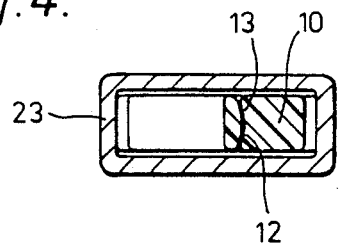
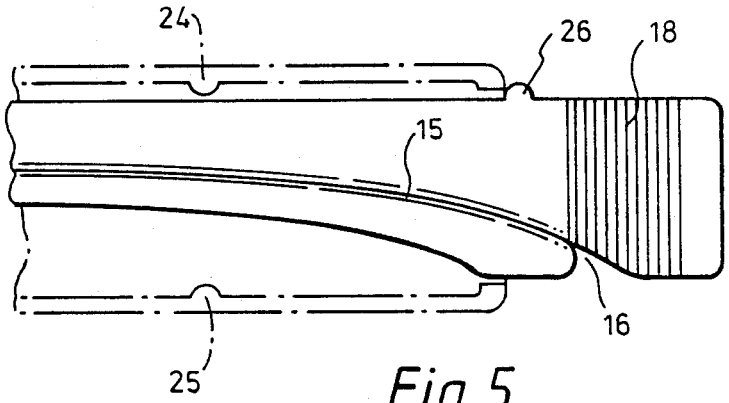
Fig. 5.
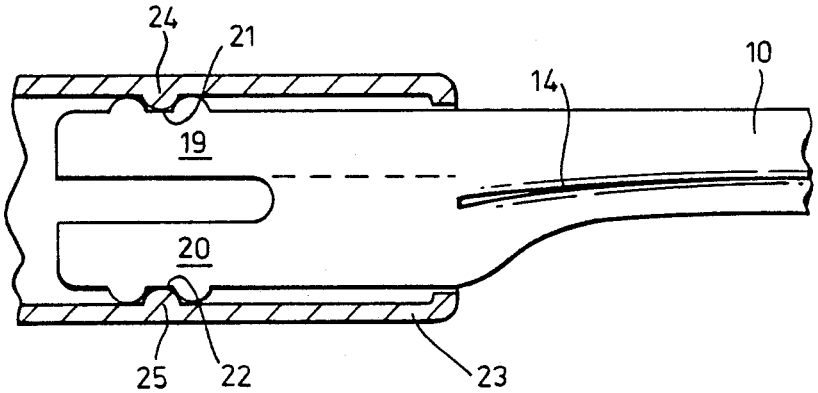
Fig. 6.

PAPER HOLDER

BACKGROUND OF THE INVENTION

At the present time many people operate keyboards, such as computer keyboards, word processor keyboards and typewriter keyboards. It is often the situation that, whilst operating the keyboard, the operator has to read a piece of paper.

The present invention seeks to provide a holder which can be readily utilised to hold a piece of paper in such a position that it can be readily viewed by a person operating a keyboard, but it is to be understood that embodiments of the invention may be utilised for other purposes.

It has been propsed previously to provide a holder for a piece of paper, to hold the piece of paper in a position where the piece of paper can be viewed by a person operating a keyboard, and one typical holder of this type consists of an arcuate support plate which is associated with a flexible transparent arcuate strip which can move from a position in which it is located in a bowed position biassed towards the arcuate support plate, through a dead centre position to a second position in which it is bowed away from the arcuate support plate. Thus a piece of paper may be located adjacent the arcuate support plate when the t,ransparent strip is in the second position bowed away from the support plate, and then the arcuate strip many be snapped through the dead centre position, thus trapping the piece of paper and holding it in position. However, in utilising a device of this type it is necessary to use two hands in order to place the paper in position. Also the device is relatively expensive to produce.

BRIEF SUMMARY OF THE INVENTION

According to this invention there is provided a paper holder, said paper holder comprising an elongate member, said elongate member defining therein a slot, said slot being non-linear in at least one dimension, and means adapted to mount said member in position with the slotted portion projecting so that a sheet of paper may be inserted in said slot.

Preferably said slot is arcuate in at least one dimension.

Conveniently said slot is arcuate in two dimensions.

Advantageously said slot terminates with a curved portion leading to an open mouth, the mouth being wider than the width of the slot.

Preferably siad member is formed of a moulded plastic material.

Conveniently the paper holder is formed of ABS or an acrylic plastic material.

In one embodiment said elongate member defines two said slots, the slots being disposed at opposite ends of the elongate member, the elongate member being of symmetrical design.

In an alternative embodiment the elongate member is telescopically received within a housing, means being provided to retain the elongate member in a retracted position in which it is substantially contained within the housing and an extended position in which it substantially projects from said housing.

Preferably the end of the elongate member adjacent the end of the slot is provided with ribbing or the like and projects beyond one end of said housing.

Conveniently the other end of said elongate member is bifurcated, the bifurcated poritons defining means adapted to cooperate with corresponding means formed on the side walls of the housing to perform the said function of retaining the elongate member in the retracted position and in the extending position.

Advantageously each bifurcation defines thereon a recess, and the side walls of the housing define two opposed pairs of projections adapted to engage said recesses to constitute the said retaining means.

In another embodiment the elongate member is rotatably mounted on a support.

Preferably the said elongate member defines an aperture adjacent one end thereof, there being a threaded plug passed through said aperture and into a threaded bore on said support to rotatably mount the elongate member in the support.

Conveniently the means to mount said member in position comprise double sided adhesive tape.

BRIEF INTRODUCTION OF THE DRAWING

FIG. 1 is a plan view of one embodiment of a paper holder in accordance with the invention;

FIG. 2 is a top view, partly cut away of a second embodiment of a paper holder, FIG. 3 is a view, in perspective, showing the second embodiment ready for use, FIG. 4 is a sectional view taken on the line IV—IV of FIG. 2, FIG. 5 is an enlarged view of part of FIG. 2, FIG. 6 is an enlarged view showing part of the apparatus of FIG. 2 in an alternative position, FIG. 7 is a plan view of a third embodiment of the invention, and FIG. 8 is an exploded view of the third embodiment.

DETAILED DESCRIPTION OF PREFERRED EMBODIMENTS

Figure 1:
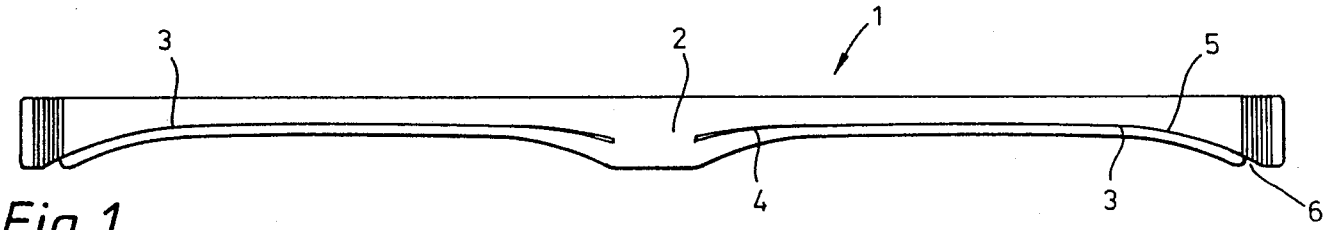

Referring initially to FIG. 1 a paper holder in accordance with the invention consists of an elongate integrally moulded plastics material member 1. As will become apparent from the following description, the member is symmetrical and effectively comprises two paper holders formed as one component.

The central part 2 of the elongate member may be secured to a visual display unit, for example by means of an adhesive. It is envisaged that double-sided adhesive tape may be sued for this purpose. One part of the member 1 will hang over the edge of the visual display unit.

The elongate member 1 is provided, at each end, with a double arcuate slot 3. The double arcuate slot is of an arcuate configuration in two planes. As can be seen, when the slot is viewed from above the slot is of arcuate form 4, 5. The slot 3 thus has two terminal arcuate portions 4, 5 interconnected by a linear portion. However, the slot may have any desired nonlinear form. The surving arcuate slot 3 emerges at a mouth 6 formed in one side edge of the elongate member. The slot 3 itself is arcuate 4, 5 in the vertical sense. That is to say the slot 3 has a curved configuration, the tangent to that curve lying in the plane of the elongate member 1. However, the slot is also arcuate in the vertical plane. Thus the cross-section of the slot is arcuate and the tangent to the arcuate cross-section is a line peripendicular to the plane of the elongate member 1. Thus the slot is double arcuate, being arcuate relative to two planes.

The paper holder, described above may be fabricated from any appropriate material, and may thus, for example, be moulded from ABS or an acrylic material.

In use, the paper holder 1 is mounted in position, for example on top of a visual display unit with a part carrying one slot 3 extending beyond the visual display unit. A sheet of paper may then have one edge thereof introduced into the slot, and as the paper is pushed fully into the slot the paper will be bent in two planes because of the fact that the slot is arcuate in two planes. This bending of the paper tends to stiffen the paper, and thus, although only part of the paper is accommodated within the slot, the sheet of paper is held in a substantially stiff and erect positoin. Again, because of the double arcuate nature of the slot, the paper is retained in position, although the paper can be moved relative to the paper holder by applying a firm pull to the paper.

It will thus be appreciated that the described embodiment of the invention may be utilised to hold a sheet of paper in a position where the paper is readily visible to a person operating a keyboard associated with the visual display unit.

The described device is made with two slots 3, so that the device may be mounted either to over hang the right hand side of the visual display unit, or may be utilised to overhang the left hand side of a visual display unit. However, it is to be appreciated that alternatively the device may only have one slot, the device then being reversible, the device being mounted in one position with the slot overhanging one side of the visual display unit or being rotated and inverted so that the slot hangs over the other side of the visual display unit.

Any appropriate means may be provided for mounting the paper holder in position and, indeed, the paper holder 1, or a corresponding paper holder having only one slot, may be mounted in position on a freestanding support.

Whilst the invention has been described with reference to a paper holding device being mounted on a visual display unit it is to be appreciated that the paper holding device may alternatively be mounted on a wordprocessor keyboard or on a typewriter. Indeed, the device may be mounted in positon on any suitable support.

Referring now to FIGS. 2 to 6 of the accompanying is illustrated in which an elongate member 10 is provided with an arcuate slot 13 having an open mouth 16. One free end of the member, adjacent the open mouth 16, is provided with ribs or knurling 18. The other end is provided with a bifurcated poriton 19, 20, the exterior surfaces of the bifurcated poriton defining vertically extending recesses 21, 22. The described elongate member 10 is telescopically mounted within a rectangular cross-sectioned tubular member 23. The member 23 has, adjacent each end, opposed pairs of ribs 24, 25, formed in the side walls of the housing. It can be seen, from FIG. 6, that the recesses 21, 22 formed in the bifurcated part engage one pair of ribs 24, 25.

The slot is arcuate in two planes, having arcuate poritons 14, 15 in the horizontal plane, and having an arcuate cross-section 12 (as can be seen from FIG. 4) in the vertical plane.

It will be apprecitaed that, when the ribbed portion 18 of the elongate member 10 is grasped manually and is pulled, the bifurcations 19, 20 will be biassed to move towards one another by the camming action provided by the cooperation between the ribs 24, 25 and the recesses 21, 22. Thus the bifurcations 19, 20 will move inwardly permitting the elongate member 10 to move telescopically within the tubular housing 23. The bifurcations will again move resiliently inwardly when they approach the other pair of ribs 24, 25 and the bifurcations will resiliently move outwardly when the recesses 21, 22 are aligned with this second pair of ribs 24, 25. Thus the elongate member will be "snapped" into a position in which it is protruding from the housing 23, as shown in FIGS. 3 and 6, and is firmly retained in position by means of the engagement between the ribs 24, 25 and the recesses 21, 22.

Figure 2:
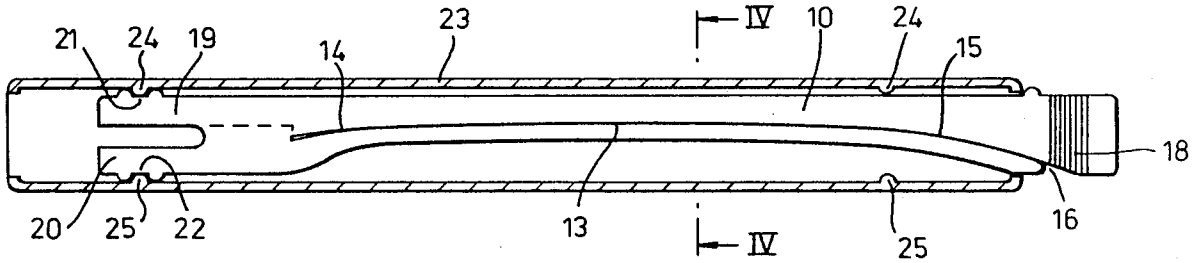

It is to be appreciated that firm inward pressure applied to the ribbed end 18 of the elongate member 10 will return the elongate member 10 to its initial position, where again it will be "snapped" into position, as shown in FIGS. 2 and 5. A stop 26 formed on the elongate member 10 will engage the housing 23.

Figure 3:
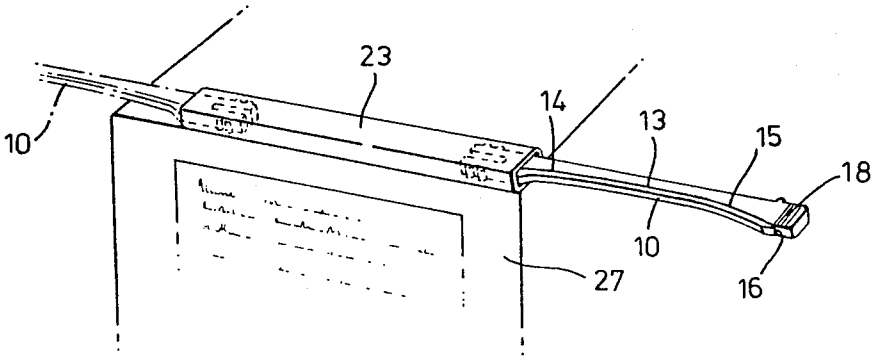

It is envisaged that the housing 23 will be mounted in position on a visual display unit, 27 as shown in FIG. 3 or on a typewriter, word processor keyboard or the like, and the elongate member may be moved between its retracted position, in which it projects beyond the housing 23, and an alternative, or storage position, in which it is retained within the housing 23. As is shown, the elongate member may overhang to the right, but as shown in phantom may alternatively overhang to the left.

It will be readily understood that when the member 10 is in the extended position the slot 13 is accessible, and a sheet of paper may be inserted into the slot 13 through the mouth 16 in a manner corresponding to that described above with reference to FIG. 1.

The housing 23 may be adhered to any appropriate surface in any appropriate orientation. If the housing 23 is adhered to a support which, at the end of a working day, is covered up with a cover, the elongate member 10 may be moved telescopically to its retracted position before the cover is placed in position.

Figure 7:
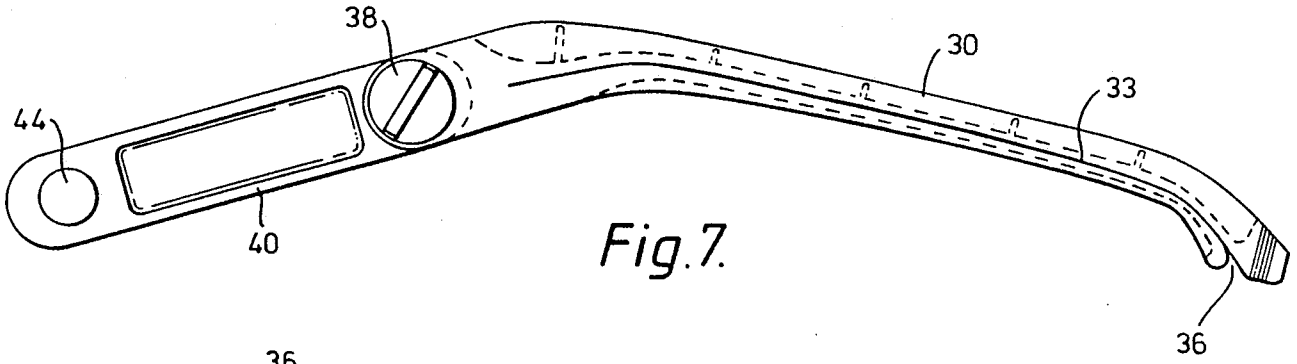
Figure 8:
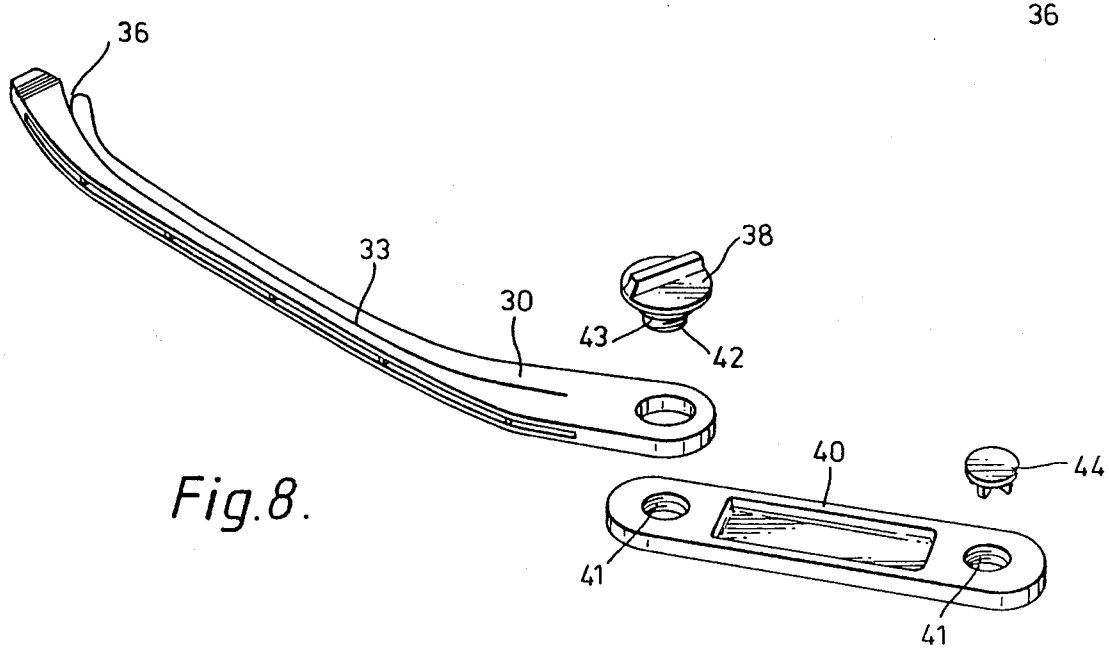

FIGS. 7 and 8 illustrate yet another embodiment of the invention in which an elongate member 30, having a double arcuate slot 33 with an open mouth 36, is provided with an aperture 34 at the end remote from the mouth. The slot 33 has a configuration corresponding to that of the slots described above. A threaded plug 38 may pass through the aperture 34 to rotatably mount the elongate member 30 on a suport 40. The support 40 has a threaded bore 41 to receive a threaded part 42 of the plug, and a non-threaded part 43 of the plug is received within the aperture 34 to rotatably support the elongate member. The support 40 may be secured to any convenient support surface and thus the elongate member may be rotated to any desired position.

It will be observed that the support 40 has two corresponding threaded holes 41, one at each end, to enable the device to cantilever over the left hand edge or the right hand edge of a support surface. The hole 41 that is not in use is provided with a cover 44.

Whilst the invention has been described with reference to exemplary embodiments it is to be appreciated that many further modifications may be effected without departing from the scope of the invention.

It is to be understood that the invention has only been described by way of example, and many modified embodiments of the inveniton may be devised within the scope of the inveniton as defined by the following claims.

What is claimed is:

1. A paper holder, said paper holder comprising a single, integrally formed elongate member, said elongate member defining therein a slot, said slot being arcuate in at least one dimension and having a central linear section with terminal arcuate portions, the slot terminating at one end with an arcuate portion leading to an open mouth, the mouth being wider than the width of the slot, and means in the form of a support adapted to mount said member in position with the open mouth projecting so that a sheet of paper may be inserted in said slot without requiring the manual opening of the slot, the elongate member defining an aperture adjacent one end thereof through which a threaded plug passes, the threaded plug extending into a threaded bore in said support so as to rotatably mount the elongate member upon said support.

2. A paper holder, said paper holder comprising a single integrally formed elongate member, the elongate member having a rear portion constituting a rear support for a sheet of paper received in the holder, the rear portion being non-linear in at least one dimension, and a front portion constituting a front support for a sheet of paper received in the holder, the front portion being non-linear in at least one dimension in the same sense as the rear portion, the rear portion and the front portion defining a non-linear slot therebetween said slot having a closed end and an open end, the open end comprising an open mouth wider than the rest of the slot, the said rest of the slot being substantially uniform, and extending to the closed end, where the front portion and the rear portion are integrally formed, the non-linearity of the slot serving to bend and stiffen a sheet of paper received in the holder such that the paper is held in an upright position and additionally serving to retain the paper within the slot, the paper holder further comprising means adapted to mount the elongate member in position with the slot projecting so that a sheet of paper may be inserted into the open mouth at the open end of the slot.

3. A paper holder according to claim 2 wherein said elongate member is formed of a moulded plastic material.

4. A paper holder according to claim 2 wherein the paper holder is formed of ABS or an acrylic plastic material.

5. A paper holder according to claim 2 wherein said elongate member defines two said slots, the slots being disposed opposite ends of the elongate member, the elongate member being of symmetrical design.

6. A paper holder according to claim 2 wherein the elongate member is telescopically received within a housing, means being provided to retain the elongate member in a retracted position in which it is substantially contained within the housing and an extended position in which it substantially projects from said housing.

7. A paper holder according to claim 6 wherein the end of the elongate member adjacent the end of the slot is provided with ribbing or the like and projects beyond one end of said housing.

8. A paper holder according to claim 7 wherein the other end of said elongate member is bifurcated, the bifurcated portions defining means adapted to cooperate with corresponding means formed on the side walls of the housing to perform the said function of retaining the elongate member in the retracted position and in the extended position.

9. A paper holder according to claim 8 wherein each bifurcation defines thereon a recess, and the side walls of the housing define two opposed pairs of projections adapted to engage said recesses to constitute the said retaining means.

10. A paper holder according to claim 2 wherein the means to mount said member in postion comprise double sided adhesive tape.

11. A paper holder, said paper holder comprising a single integrally formed elongate member, the elongate member having a rear portion constituting a rear support for a sheet of paper received in the holder, the rear portion being non-linear in at least one dimension, and a front portion constituting a front support for a sheet of paper received in the holder, the front portion being non-linear in at least one dimension in the same sense as the rear portion, the rear portion and the front portion defining a non-linear slot therebetween said slot having a closed end and an open end, the open end comprising an open mouth wider than the rest of the slot, the said rest of the slot being substantially uniform, and extending to the closed end, where the front portion and the rear portion are integrally formed, the slot having a central linear section and terminal arcuate sections adjacent each end of the slot, the non-linearity of the slot serving to bend and stiffen a sheet of paper received in the holder such that the paper is held in an upright position and additionally serving to retain the paper within the slot, the paper holder further comprising means adapted to mount the elongate member in position with the slot projecting so that a sheet of paper may be inserted into the open mouth at the open end of the slot.

12. A paper holder, said paper holder comprising a single integrally formed elongate member, the elongate member having a rear portion sonstituting a rear support for a sheet of paper received in the holder, the rear portion being non-linear in at least one dimension, and a front portion constituting a front support for a sheet of paper received in the holder, the front portion being non-linear in at least one dimension in the same sense as the rear portion, the rear portion and the front portion defining a non-linear slot therebetween said slot having a closed end and an open end, the open end comprising an open mouth wider than the rest of the slot, the said rest of the slot being substantially uniform, and extending to the closed end, where the front portion and the rear portion are integrally formed, the non-linearity of the slot serving to bend and stiffen a sheet of paper received in the holder such that the paper is held in upright position and additionally serving to retain the paper within the slot, the paper holder further comprising means in the form of a support adapted to mount the elongate member in position with the slot projecting so that a sheet of paper may be inserted into the open mouth at the open end of the slot, the elongate member being rotatably mounted upon the support by means of a threaded plug which is received in a threaded bore provided in the support, the threaded plug extending in a direction substantially perpendicular to the axis of the elongate member.

13. A paper holder, said paper holder comprising a single integrally formed elongate member, the elongate member having a rear portion sonstituting a rear support for a sheet of paper received in the holder, the rear portion being non-linear in at least one dimension, and a front portion constituting a front support for a sheet of paper received in the holder, the front portion being non-linear in at least one dimension in the same sense as the rear portion, the rear portion and the front portion defining a non-linear slot therebetween said slot having a closed end and an open end, the open end comprising an open mouth wider than the rest of the slot, the said rest of the slot being substantially uniform, and extending to the closed end, where the front portion and the rear portion are integrally formed, the slot having a central linear section and terminal arcuate sections adjacent each end of the slot, the non-linearity of the slot serving to bend and stiffen a sheet of paper received in the folder such that the paper is held in an upright position and additionally serving to retain the paper within the slot, the paper holder further comprising means in the form of a support adapted to mount the elongate member in position with the slot projecting so that a sheet of paper may be inserted into the open mouth at the open end of the slot, the elongate member being rotatably mounted upon the support by means of a threaded plug which is received in a threaded bore provided in the support, the threaded plug extending in a direction substantially perpendicular to the axis of the elongate member.

* * * * *